US007666822B2

(12) United States Patent
Imai et al.

(10) Patent No.: US 7,666,822 B2
(45) Date of Patent: Feb. 23, 2010

(54) LUBRICATING OIL FOR SHIP PROPULSOR BEARINGS

(75) Inventors: Takaichi Imai, Kyoto (JP); Tsuyoshi Okamoto, Kyoto (JP)

(73) Assignee: Kobelco Eagle Marine Engineering Co., Ltd., Tokyo (JP)

( * ) Notice: Subject to any disclaimer, the term of this patent is extended or adjusted under 35 U.S.C. 154(b) by 590 days.

(21) Appl. No.: 11/355,186

(22) Filed: Feb. 16, 2006

(65) Prior Publication Data

US 2006/0217275 A1 Sep. 28, 2006

(30) Foreign Application Priority Data

Mar. 23, 2005 (JP) ..... 2005-083980

(51) Int. Cl.
*C10M 105/18* (2006.01)
*C10M 141/06* (2006.01)

(52) U.S. Cl. ..... 508/583; 508/459; 508/545; 508/539; 508/577

(58) Field of Classification Search ..... 508/159, 508/321, 459, 539, 577, 583, 545
See application file for complete search history.

(56) References Cited

U.S. PATENT DOCUMENTS

| | | | | |
|---|---|---|---|---|
| 3,970,574 | A * | 7/1976 | Niedzielski | 252/79 |
| 6,054,422 | A | 4/2000 | Ward et al. | |
| 2004/0235679 | A1 | 11/2004 | Kurosky et al. | |

FOREIGN PATENT DOCUMENTS

| | | | |
|---|---|---|---|
| GB | 1081294 | A * | 8/1967 |
| JP | 53139065 | A * | 12/1978 |
| JP | 5-331481 | A | 12/1993 |
| JP | 11-323373 | A | 11/1999 |
| WO | WO 2004/053031 | A2 | 6/2004 |

OTHER PUBLICATIONS

European Search Report dated Aug. 4, 2008; Application No. 06003292.7-2104 / 1705236.

* cited by examiner

*Primary Examiner*—Glenn A Caldarola
*Assistant Examiner*—Taiwo Oladapo
(74) *Attorney, Agent, or Firm*—Westerman, Hattori, Daniels & Adrian, LLP

(57) ABSTRACT

The present invention has its object to provide a lubricating oil for ship propulsor bearings which is high in bearing-damaging pressure, equivalent in lubricity and anticorrosiveness to the conventional mineral oil-based lubricating oils, higher in biodegradability than in the art and miscible with seawater. The present invention provides a lubricating oil for ship propulsor bearings which comprises a water-soluble alkylene glycol and/or polyalkylene glycol (A) with a number average molecular weight of not higher than 1,000 as a base oil as well as a water-soluble thickening agent (B) and a water-soluble anticorrosive agent (C) and in which the content of (A) is 80 to 98% by weight, that of(B) is 1 to 10% by weight and that of(C) is 1 to 10% by weight, relative to the weight of the lubricating oil for ship propulsor bearings and the bearing-damaging pressure at 50° C. is not lower than 3.5 MPa.

5 Claims, No Drawings

LUBRICATING OIL FOR SHIP PROPULSOR BEARINGS

TECHNICAL FIELD

This invention relates to a lubricating oil for ship propulsor bearings, more particularly a lubricating oil for ship propulsor bearings which is miscible with seawater and high in lubricity.

BACKGROUND ART

In the art, there are two methods available for lubricating stern tube bearings; one uses seawater for lubrication, and the other uses an oil such as a mineral oil. In the case of large-sized ship stern tube bearings where the bearing load is heavy, however, the method of lubricating with seawater, which provides only poor lubricity, is inappropriate, although it produces no marine pollution problems. In large-sized ships, oil-sealed bearing units are employed and mineral oil-based bearing oils are used. However, such mineral oil-based bearing oils are immiscible with seawater and, therefore, the lubricity markedly deteriorates upon invasion of the bearing by seawater, causing the problem of propeller shaft damaging. Furthermore, since they are poor in biodegradability, their leakage into the sea produces another problem, namely they cause marine pollution. Contrivances have been made in the aspect of the sealant and sealing system for preventing such seawater invasion and lubricant leakage into seawater; it is difficult, however, to entirely prevent oil leakage. Fats and oils of the natural origin and synthetic ester type lubricating oils, which are said to be better in biodegradability than mineral oils, have also been proposed; however, they are insoluble in seawater and, upon leakage, they form oil drops, which float on the sea surface. Such oil drops can hardly be recovered or removed, causing a problem of marine pollution. A further problem is that when they are mixed with invading seawater, they are readily hydrolyzed, hence the lubricity readily decreases (refer to Tribologist, vol. 48, p. 114-121 (2003); Japanese Kokai Publication Hei-05-331481; Japanese Kokai Publication Hei-11-323373).

SUMMARY OF THE INVENTION

It is an object of the present invention to provide a lubricating oil for ship propulsor bearings which is high in bearing-damaging pressure, equivalent in lubricity and anticorrosiveness to the conventional mineral oil-based lubricating oils, higher in biodegradability than in the art and miscible with seawater.

The present inventors made intensive investigations in an attempt to solve the problems discussed above and, as a result, have now completed the present invention. Thus, the invention provides a lubricating oil for ship propulsor bearings which comprises a water-soluble alkylene glycol and/or polyalkylene glycol (A) with a number average molecular weight of not higher than 1,000 as a base oil as well as a water-soluble thickening agent (B) and a water-soluble anticorrosive agent (C) and in which the content of (A) is 80 to 98% by weight, that of (B) is 1 to 10% by weight and that of (C) is 1 to 10% by weight, relative to the weight of the lubricating oil for ship propulsor bearings and the bearing-damaging pressure at 50° C. is not lower than 3.5 MPa.

The lubricating oil for ship propulsor bearings of the present invention has the following effects:

(1) being miscible with seawater, (2) being high in bearing-damaging pressure, equivalent or superior in lubricity and anticorrosiveness to in the art, and high in biodegradability.

DETAILED DESCRIPTION OF THE INVENTION

The lubricating oil for ship propulsor bearings of the present invention has the bearing-damaging pressure at 50° C. of not lower than 3.5 MPa, preferably not lower than 3.8 MPa.

Lubricating oils showing a bearing-damaging pressure lower than 3.5 MPa cannot lubricate ship bearings to a satisfactory extent.

The bearing-damaging pressure at 50° C. can be measured by the following method.

A journal bearing constituted of a white metal (WJ2) bearing and a carbon steel (S-45C) shaft is loaded stepwise increasingly, and the lowest load at which the shaft torque exceeds a specified value (=10 N·m) is regarded as the bearing-damaging load. The bearing-damaging pressure is calculated by dividing the bearing-damaging load by the projected bearing area (=shaft diameter×bearing width). Particular conditions are shown below:

Shaft diameter: 80 mm; diameter clearance: 0.24 mm; bearing width: 20 mm; number of shaft revolutions: 360 rpm; load increasing rate: 160 N/minute.

In the practice of the present invention, each of the water-soluble alkylene glycol and/or polyalkylene glycol (A) with a number average molecular weight of not higher than 1,000 to be used as a base oil, the water-soluble thickening agent (B) and the water-soluble anticorrosive agent (C) is water-soluble. By saying "water-soluble", it is meant, in the present invention, that the weight of the objective substance capable of dissolving in 100 g of water at 25° C. is not lower than 20 g.

(A) according to the present invention has a number average molecular weight (determined by gel permeation chromatography; hereinafter abbreviated as "Mn") of not higher than 1,000, and, from the biodegradability viewpoint, preferably not higher than 800.

In addition, (A) has a level of biodegradability of preferably not lower than 60%, more preferably not lower than 65%, particularly preferably not lower than 70%.

The level of biodegradability is determined according to the method based on the OECD's testing method 301C over the testing period of 28 days. (A) with a level of biodegradability of not lower than 60% tends to make the level of biodegradability of the resulting lubricating oil be higher, and reduces marine pollution caused by leakage of the lubricating oil.

As for (A), as the water-soluble alkylene glycols, there may be mentioned glycols having an alkylene group containing 2 to 6 carbon atoms, such as ethylene glycol (level of biodegradability; 100%), 1,2-propylene glycol (level of biodegradability; 90 to 99%), 1,3-propylene glycol, and the like.

As for (A), as the water-soluble polyalkylene glycols, there may be mentioned polyalkylene glycols having an alkylene group containing 2 to 6 carbon atoms and a polymerization degree of 2 to 22, such as diethylene glycol, triethylene glycol, polyethylene glycol with a polymerization degree of 4 to 22 (level of biodegradability; 60 to 70%), di-1,2-propylene glycol, and random copolymers, block copolymers and random-block-mixed copolymers derived from polyethylene/propylene with a polymerization degree of 2 to 20, and the like.

Preferred among (A) is 1,2-propylene glycol, polyethylene glycol with a polymerization degree of 2 to 22, and the combination of these.

As the water-soluble thickening agents (B), there may be mentioned thickening polymer compounds with a Mn of not lower than 10,000, preferably 10,000 to 1,000,000, such as alkylene oxide (hereinafter abbreviated as "AO") adducts derived from a polyhydric alcohol, AO adducts derived from a polyamine, polycarboxylic acids (salts), polyvinyl alcohol and cellulose derivatives, and the like.

Preferred among (B) is the AO adducts derived from a polyhydric alcohol and the AO adducts derived from a polyamine.

As the polyhydric alcohols which compose the AO adduct derived from a polyhydric alcohol, there may be mentioned dihydric to tetrahydric or further polyols, such as ethylene glycol, 1,2-propylene glycol, 1,3-propylene glycol, 1,6-hexylene glycol, glycerol, trimethylolpropane, pentaerythritol, sorbitol and the like.

As polyamines which compose the AO adduct derived from a polyamine, there may be mentioned (poly) alkylene polyamines (for example, ethylenediamine, diethylenetriamine and tetraethylenepentamine), and polyamidepolyamines (for example, polyamidepolyamine obtainable by condensation of dimeric acid and the above-mentioned polyamine).

As AOs, there may be mentioned alkylene oxides containing 2 to 4 carbon atoms, such as ethylene oxide (hereinafter abbreviated as "EO"), 1,2-propylene oxide (hereinafter abbreviated as "PO"), 1,2-butylene oxide and tetrahydrofuran. When two or more species of AO are used in combination in the above-mentioned AO adduct, there may be mentioned block adducts and random adducts, and mixtures of these.

Among the AO adducts, preferred is a block adduct, and particularly preferred is a block adduct derived from an EO and a PO.

Among the AO adducts derived from a polyhydric alcohol, particularly preferred are an EO/PO adduct (by saying "/", it is meant a block adduct; hereinafter the same shall apply) derived from 1,6-hexylene glycol, and an EO/PO adduct derived from glycerol.

Among the AO adducts derived from a polyamine, particularly preferred is an EO/PO adduct derived from a polyamidepolyamine.

As the polycarboxylic acids (salts), there may be mentioned polyacrylic acid (salt), polymethacrylic acid (salt), and a copolymer obtained by copolymerization of 80 mole % or more of (meth) acrylic acid (salt) and 20 mole % or less of other vinyl monomers. As the salts, there may be mentioned alkali metal (sodium, potassium, and the like) salts and amine salts (triethanolamine, triisopropanolamine, and the like). Preferred is the alkali metal salt.

As the cellulose derivatives, there may be mentioned carboxymethylcellulose, acethylcellulose, cellulose phosphate, ethylcellulose, hydroxyethylcellulose, and the like.

As the water-soluble anticorrosive agents (C), there may be mentioned amine compounds (C1), carboxylic acids (C2) and carboxylic acid salts (C3), with Mn of not higher than 1,000.

As (C1), there may be mentioned, for example, alkanolamines (monoethanolamine, diethanolamine, triethanolamine, monoisopropanolamine, diisopropanolamine, triisopropanolamine, and the like), EO (1 to 20 moles) adducts derived from an alkyl (C1-C24) amine and EO (1 to 20 moles) adducts derived from a cyclic (C6-C24) amine (an EO adduct derived from cyclohexylamine).

Preferred among (C1) are alkanolamines (particularly, triethanolamine and diethanolamine) and an EO adduct derived from cyclohexylamine.

As (C2), there may be mentioned monocarboxylic acids containing 8 to 22 carbon atoms (for example, aliphatic saturated monocarboxylic acids such as caprylic acid, lauric acid, myristic acid and palmitic acid, and aliphatic unsaturated carboxylic acids such as oleic acid), dicarboxylic acids containing 6 to 36 carbon atoms (for example, azelaic acid, sebacic acid and 2-dodecanoic acid), aliphatic sarcosine acids (for example, lauryl sarcosine acid and oleyl sarcosine acid), alkenyl succinic acids (for example, octenyl succinic acid, dodecenyl succinic acid, pentadecenyl succinic acid and octadecenyl succinic acid).

Preferred among (C2) are alkenyl succinic acids, and particularly preferred are octenyl succinic acid and dodecenyl succinic acid.

As (C3), there may be mentioned carboxylic acid alkali metal salts (C31) derived from (C2) and an alkali metal (for example, potassium lauryl sarcosinate and potassium oleyl sarcosinate), and carboxylic acid amine salts (C32) derived from (C2) and (C1).

The carboxylic acid amine salts (C32) may be prepared in advance, and preferably is a salt produced by neutralization accompanied by incorporation of (C2) and (C1) during the process for producing the lubricating oil for ship propulsor bearings according to the present invention.

The proportion between (C2) and (C1) ((C2)/(C1)) at the salt formation by neutralization in equivalent is preferably 1/0.3 to 3 and more preferably 1/0.5 to 2, and that proportion in weight is preferably 1/0.3 to 2 and more preferably 1/0.4 to 1.5. Excessive (C1) or (C2), as such, corresponds to the water-soluble anticorrosive agent (C) according to the present invention.

(C) may be composed of two or more species. In this case, (C) may be composed of two or more species from (C1), (C2) and (C3), respectively, or a combination of (C1) and (C2), that of (C1) and (C3), or that of (C2) and (C3), or a further combination of these. Among these combinations, more preferred are that of (C1) and (C2), that of (C1) and (C3), and that of (C2) and (C3), particularly preferred are that of (C1) and (C2), and that of (C1) and (C3). By incorporating (C1) and (C2) in combination, the carboxylic acid amine salt (C32) is formed as above mentioned.

In the present invention, the content of (A) is 80 to 98% by weight, preferably 83 to 97% (hereinafter, "%" means "% by weight" unless otherwise specified) and more preferably 85 to 95%, the content of (B) is 1 to 10%, preferably 2 to 10% and more preferably 4 to 10%, and the content of (C) is 1 to 10%, preferably 1 to 9% and more preferably 1 to 8%, relative to the weight of the lubricating oil for ship propulsor bearings.

When the content of (A) is less than 80%, the resultant lubricating oil becomes poor in lubricity. When the content of (B) is less than 1%, the resultant lubricating oil becomes insufficient in viscosity as a lubricating oil for ship propulsor bearings to thereby be poor in lubricity. When the content of (B) exceeds 10%, the resultant lubricating oil becomes poor in biodegradability. When the content of (C) is less than 1%, the resultant lubricating oil becomes poor in anticorrosiveness and lubricity, and when the content exceeds 10%, the resultant lubricating oil becomes poor in biodegradability.

The lubricating oil for ship propulsor bearings according to the present invention may further contain water of not higher than 10%, preferably 0 or not higher than 5%, and a pH control agent of not higher than 5%, preferably 0 or not higher than 3%, relative to the weight of the lubricating oil.

PH of the lubricating oil for ship propulsor bearings according to the present invention is preferably 8 to 10, more preferably 9 to 10, and preferably adjusted within these range using the pH control agent.

As the pH control agent, there may be used alkaline inorganic compounds (sodium hydroxide, potassium hydroxide, and the like) and acidic inorganic compounds (hydrochloric acid, sulfuric acid, phosphoric acid, and the like). Preferred among these are alkaline inorganic compounds. Preferably, the pH control agent is used as an aqueous solution containing 10 to 50% of the agent.

PH of the lubricating oil can be determined by two-fold dilution of the oil with ion-exchanged water and using a pH meter "M-12" (manufactured by HORIBA, Ltd.)

The lubricating oil for ship propulsor bearings according to the present invention may contain one or more species selected from the group consisting of oil-based agents, antioxidants and antifoaming agents, if necessary.

As the oil-based agents, there may be mentioned salts of alkyl or alkenyl phosphate containing 8 to 22 carbon atoms (for example, salts of lauryl phosphate, salts of palmityl phosphate and salts of oleyl phosphate; the salt is an alkali metal salt, for example); aliphatic alkanolamide containing 8 to 22 carbon atoms (for example, lauryl diethanolamide and oleyl diethanolamide); and the like.

Preferred among these is aliphatic diethanolamide containing 8 to 22 carbon atoms.

As the antioxidants, there may be mentioned phenolic antioxidants such as 2,4-dimethyl-6-tert-butylphenol and 4,4-butylidenebis(6-tert-butylmetacresol; amine antioxidants such as N-phenyl-4-octylphenylamine and bis(4-octylphenyl)amine; zinc dihydrocarbyl (C1-C36) dithiophosphate and zinc diallyl dithiophosphate; and the like.

As the antifoaming agents, there may be mentioned silicone antifoaming agents, polypropylene glycol (water-insoluble), polypropylene glycol monoalkylether, (water-insoluble), and the like.

The content of each of the oil-based agent, the antioxidant and the antifoaming agent is not higher than 8%, preferably not higher than 6%, respectively, relative to the total weight of (A) to (C).

The lubricating oil for ship propulsor bearings according to the present invention has a level of biodegradability of preferably not lower than 60%, more preferably not lower than 70%.

The level of biodegradability of the lubricating oil for ship propulsor bearings is determined by the same method as the method for determining the level of biodegradability for (A) mentioned above.

The lubricating oil for ship propulsor bearings according to the present invention is optionally miscible with seawater at any proportion. For this reason, the lubricity does not deteriorate even upon invasion of the bearing by seawater, because said oil according to the invention is not emulsified unlike in the case of the conventional mineral oil-based lubricating oil and keeps its uniformity.

In addition, the lubricating oil for ship propulsor bearings according to the present invention may have a stable lubricity, because said oil is unlikely hydrolyzed chemically by water or seawater.

Furthermore, said oil does not float on the sea surface upon leakage and is readily biodegraded, hence unlikely causes a problem of marine pollution.

The viscosity of the lubricating oil for ship propulsor bearings according to the present invention at 40° C. is preferably 10 to 180 $mm^2/s$, more preferably 40 to 120 $mm^2/s$. When the viscosity is 10 $mm^2/s$ or higher, the lubricity tends to be better. On the other hand, when it is 180 $mm^2/s$ or lower, said oil becomes less sticky and has small driving load.

Generally, the lubricating oil for ship propulsor bearings according to the present invention can be obtained by mixing while stirring (A) to (C), and, if necessary, water, oil-based agents, antioxidants and/or antifoaming agents, at 40 to 60° C. for 1 to 4 hours, and, if necessary, adjusting the pH using pH control agents.

The lubricating oil for ship propulsor bearings according to the present invention can be suitably used as a lubricating oil for bearing parts used in ships, particularly as a lubricating oil for stern tube bearings. For example, the mixed liquid prepared as above-mentioned is used as a lubricating oil for preventing wear of a propeller shaft or a bearing constituted of a white metal or a resin by being filled into the sealing system for stern tubes as such.

The lubricating oil for ship propulsor bearings according to the present invention is high in bearing-damaging pressure, miscible with seawater, fine in biodegradability, and excellent in lubricity and anticorrosiveness, and hence suitable as a bearing oil for propeller shafts of ships and the like.

BEST MODES FOR CARRYING OUT THE INVENTION

The present invention will be described in more detail by referring to the following Examples though the present invention is not limited to these Examples. In the following, "part(s)" means "part(s) by weight".

EXAMPLES 1 to 4, COMPARATIVE EXAMPLES 1 to 4

1,000 parts of each of the lubricating oils for ship propulsor bearings according to the present invention (E1) to (E4) and comparative lubricating oils for ship propulsor bearings (F1) to (F3) were obtained by mixing the mixed materials shown in Table 1 at the shown amount at 50 to 60° C. with stirring, and adjusting pH thereof to 9.5±0.1 with a 50% aqueous solution of potassium hydroxide. As Comparative Example 4 (F4), the commercially available mineral oil-based bearing oil ("NUTO 68"; product of Exxon Mobil Corporation) was used.

The viscosity values ($mm^2/s$) of these at 40° C. are shown in Table 1.

The results from the determination of bearing-damaging pressure at 50° C. according to the above-mentioned method are also shown in Table 1

Shortened symbols in Table 1 denote the following materials.

PEG-200: polyethylene glycol (Mn=200) (level of biodegradability; 60 to 70%),

PEG-300: polyethylene glycol (Mn=300) (level of biodegradability; 60 to 70%),

PG: 1,2-propylene glycol (Mn=76),

PEG-2000: polyethylene glycol (Mn=2,000),

Sorbi-EO/PO: an EO/PO adduct derived from sorbitol (Mn=10,000; mole fraction=80/20), HG-EO/PO: an EO/PO adduct derived from hexylene glycol (Mn=18,000; mole fraction=75/25), Polyamide-EO/PO: an EO/PO adduct derived from dimeric acid polyamidepolyamine (Mn=190,000; mole fraction=80/20), GL-EO/PO: an EO/PO adduct derived from glycerol (Mn=45,000; EO/PO=65/35), DSA: dodecenyl succinic acid, OSA: octenyl succinic acid, Cyclohexylamine EO: an EO adduct derived from cyclohexylamine (Mn=187).

TABLE 1

| | | | Example | | | | Comparative Example | | | |
|---|---|---|---|---|---|---|---|---|---|---|
| | | | 1 | 2 | 3 | 4 | 1 | 2 | 3 | 4 |
| Lubricating oil | | | E1 | E2 | E3 | E4 | F1 | F2 | F3 | F4 |
| Mixed material | A | PEG-200 | 85 | | | | | | | |
| | | PEG-300 | | 86 | | 88 | | | 95 | |
| | | PG | | | 86 | | | | | |
| | | PEG-2000 | | | | | 50 | | | |
| | | Sorbi-EO/PO | | | | | | 53 | | |
| | B | HG-EO/PO | 10 | | | | | | 5 | |
| | | Polyamide-EO/PO | | 6 | | 6 | | | | |
| | | GL-EO/PO | | | 6 | | 5 | | | |
| | C C1 | Triethanolamine | | 1 | 2 | | 4 | | | |
| | | Diethanolamine | | | | | | 2 | | |
| | | Cyclohexylamine EO | 3 | | | 1 | | | | |
| | C2 | DSA | | | 2 | | | | | |
| | | OSA | | 2 | | 2 | | | | |
| | C3 | Potassium lauryl sarcosinate | 2 | | | | | | | |
| | | Potassium oleyl sarcosinate | | | | | | 3 | | |
| | Water | | | 3.5 | 2 | 2 | 41 | 40 | | |
| | 50% aqueous solution of potassium hydroxide | | | 1.5 | 2 | 1 | | 2 | | |
| Mineral oil-based bearing oil | | | | | | | | | | 100 |
| Viscosity ($mm^2/s$) | | | 72 | 75 | 70 | 80 | 65 | 62 | 62 | 68 |
| Bearing-damaging pressure (MPa) | | | 3.8 | 4.0 | 4.5 | 4.3 | 2.8 | 3.2 | 2.7 | 3.3 |

The biodegradability, lubricity and anticorrosiveness were determined for the lubricating oils for ship propulsor bearings thus obtained.

These determinations were carried out as follows. The results are shown in Table 2.

(1) Level of Biodegradability

The rate of degradability was determined by measuring TOC before and after 28-days incubation according to the method based on the OECD's testing method 301C. As activated sludge, the sludge purchased by The Chemicals Evaluation and Research Institute (incorporated foundation) was used.

(2) Lubricity

The evaluation was carried out by determining the friction coefficient for point contact of a steel sphere and plane steel disc (load; 100 N) and the diameter of worn part on the steel sphere using the test system for evaluating oscillatory friction and wear properties (manufactured by Optimol Instruments; SRV test system). The test conditions are shown below.

Amplitude: 2 mm; frequency: 50 Hz; temperature: 30° C.; time: 10 minutes; friction coefficient: average taken over 10 minutes; diameter of worn part: diameter of worn part on the 10-mm steel sphere; oil slick breaking: the state of friction coefficient rising.

Excellent: No change in friction coefficient; fair: slight change in friction coefficient; poor: significant change in friction coefficient.

(3) Anticorrosiveness

The evaluation was carried out according to the method for determining the corrosion-preventing properties of lubricating oil (JIS K2510).

To the lubricating oil for ship propulsor bearings was added 10% by weight of seawater, relative to the weight of said oil, and into the resulting mixed solution, a steel bar (S20C), which had been polished and washed, was immersed at 60° C. for 3 days, and the state of the corrosion occurrence was then observed. During the immersion, stirring of the mixed solution was continued.

Excellent: No corrosion is observed; fair: several corroded parts are observed; poor: dozen or so corroded parts are observed.

TABLE 2

| | | Example | | | | Comparative Example | | | |
|---|---|---|---|---|---|---|---|---|---|
| | | E1 | E2 | E3 | E4 | F1 | F2 | F3 | F4 |
| Biodegradability (%) | | 72 | 65 | 68 | 64 | 38 | 12 | 64 | 20> |
| Lubricity | Oil slick breaking | Excellent | Excellent | Excellent | Excellent | Poor | Excellent | Poor | Excellent |
| | Friction coefficient | 0.110 | 0.102 | 0.118 | 0.112 | 0.145 | 0.120 | 0.500 | 0.130 |
| | Diameter of worn part | 0.398 | 0.410 | 0.403 | 0.395 | 0.556 | 0.405 | 0.623 | 0.411 |
| Anticorrosiveness | | Excellent | Excellent | Excellent | Excellent | Fair | Excellent | Poor | Excellent |

As is obvious from Table 1 and 2, the lubricating oils for ship propulsor bearings according to the present invention have high bearing-damaging pressure of not lower than 3.5 MPa, and are also excellent in all of biodegradability, lubricity and anticorrosiveness. To the contrary, the lubricating oils of Comparative Examples have low bearing-damaging pressure of lower than 3.5 MPa, and are inferior in at least one properties of biodegradability, lubricity and anticorrosiveness than the lubricating oils of Examples.

The invention claimed is:

1. A lubricating oil in contact with ship propulsor bearings which comprises a water-soluble alkylene glycol and/or polyalkylene glycol (A) with a number average molecular weight of not higher than 1,000 as a base oil as well as a water-soluble thickening agent (B) and a water-soluble anticorrosive agent (C) and in which the content of (A) is 80 to 98% by weight, that of (B) is 1 to 6% by weight and that of (C) is 1 to 10% by weight, relative to the weight of the lubricating oil for ship propulsor bearings and the bearing-damaging pressure at 50° C is not lower than 3.5 MPa, and wherein the water-soluble thickening agent (B) is EO/PO adduct derived from a polyamidepolyamine, and the water-soluble thickening agent (B) has a number average molecular weight of 10,000 to 1,000,000.

2. The lubricating oil in contact with ship propulsor bearings according to claim 1 which further contains water of not higher than 10%, and a pH control agent of not higher than 5%, relative to the weight of the lubricating oil for ship propulsor bearings.

3. The lubricating oil in contact with ship propulsor bearings according to claim 1 which is optionally miscible with seawater.

4. The lubricating oil in contact with ship propulsor bearings according to claim 1 wherein the water-soluble anticorrosive agent (C) is a carboxylic acid salt.

5. The lubricating oil in contact with ship propulsor bearings according to claim 1 which has a level of biodegradability of not lower than 60%.

* * * * *